United States Patent [19]

Carver et al.

[11] 4,434,388

[45] Feb. 28, 1984

[54] ELECTRICAL LIGHTING CONTROLLER

[76] Inventors: LeRoy J. Carver, 7296 Claircrest Dr., Dayton, Ohio 45424; John K. Penrod, 2111 Lakeman Dr., Bellbrook, Ohio 45305

[21] Appl. No.: 298,918

[22] Filed: Sep. 3, 1981

[51] Int. Cl.[3] ..... G05F 1/00; H05B 37/02; H05B 39/04; H05B 41/36

[52] U.S. Cl. ..... 315/307; 315/DIG. 4; 315/DIG. 5; 315/297; 323/256; 323/257

[58] Field of Search ..... 315/DIG. 2, DIG. 5, 315/DIG. 7, 307, 297; 323/256, 257, 342

[56] References Cited

U.S. PATENT DOCUMENTS

| | | | |
|---|---|---|---|
| 3,109,975 | 11/1963 | Jacobsen | 323/256 X |
| 3,202,903 | 8/1965 | Riebs | 323/257 |
| 3,597,652 | 8/1971 | Gates, Jr. | 315/257 |
| 3,619,765 | 11/1971 | Wood | 323/257 |
| 3,913,007 | 10/1975 | Gilmore | 323/257 |
| 4,039,897 | 8/1977 | Dragoset | 315/307 |
| 4,189,664 | 2/1980 | Hirschfeld | 315/297 |
| 4,219,759 | 8/1980 | Hirschfeld | 315/307 |
| 4,237,405 | 12/1980 | Kellis | 315/307 |
| 4,346,341 | 8/1982 | Blackburn et al. | 323/257 |

*Primary Examiner*—Saxfield Chatmon, Jr.

[57] ABSTRACT

The following specification discloses an electrical power controller that has been specifically directed toward the control of lighting. The invention is directed toward reducing electrical energy consumption of high intensity discharge (HID) lamps and fluorescent lamps. The controller is connected at its input to a power line to light a bank of lamps or other electrical energy consuming devices. The output of the controller to the lamps can effectively be optimized at a substantially lower level, providing a high degree of lighting while effectuating a substantial energy saving. The output is controlled by a variable autotransformer having a drive motor that is in turn controlled by an amplifier comparator circuit. A bidirectional ramp generator provides increases and decreases of voltage in a manner to maintain the lights in their optimum operating condition. A timing circuit provides a timing function to allow for sufficient high voltage to light the HID lights over a prescribed period of time for the lights, after which it allows the system and controller to go to a low set point, which is sufficient to maintain the lamps in their lit condition. In the eventuality a load change occurs on the lighting bank, such as an increased series of lights being lit, a wattmeter output is fed back to a power change detector. This resets the controller for purposes of providing an increased amount of voltage sufficient to light the extra bank of lights while at the same time preventing the existing lights from being extinguished.

29 Claims, 5 Drawing Figures

ELECTRICAL LIGHTING CONTROLLER

BACKGROUND OF THE INVENTION

1. Field of the Invention

The field of this invention lies within the energy and voltage control art. More particularly, it lies within the art of providing a discrete amount of energy and/or voltage to a system for optimizing its function without creating a situation wherein excessive amounts of energy are utilized. More particularly, it optimizes a lighting system, such as a bank of high intensity discharge lamps or fluorescent lamps to optimize the output of light, while at the same time eliminating substantial energy consumption.

2. The Prior Art

The prior art related to energy consumption and attendant voltage control, has generally involved a discrete switching from one voltage or energy level to another voltage or energy level. The discrete switching is such that it has been performed by relay functions, potentiometers, and other devices known in the art.

Recently, it has come to the attention of industrial and commercial users of energy, that substantial savings can be accomplished if lighting costs can be decreased. In particular, lighting costs can be decreased by means of a number of methods, including the foregoing prior art methods.

some methods have incorporated the elimination of certain lights and provided other types of lights. Others have changed the characteristics of the ballasts that have been used to light certain gaseous lights.

Oftentimes, in order to save energy with regard to lighting fixtures, solid state ballasts have been resorted to. The drawback of solid state ballasts is they are expensive and must be reinstalled, thereby increasing the costs from the standpoint of the initial installation, as well as the cost of materials.

Another means of reducing energy for lighting fixtures has been to provide for new fixtures which use lesser light. This generally requires a re-engineering and remodification of the ceiling, as well as other efforts to accommodate the new fixtures. As can be appreciated, this is an expensive and generally not acceptable means for saving energy for commercial and industrial users.

In addition to the foregoing means of saving lighting energy, certain computer managed systems have been developed. In effect, this creates a local shedding wherein energy is shed in various locations or at different times of the day, depending upon demand. As can be appreciated, it is very difficult to shed energy with regard to light requirements, inasmuch as people generally have to have a certain amount of light to function and entire banks of lights cannot be shut down in certain areas.

Certain types of low energy lamps for high efficiency have also been recommended and tried in order to provide for increased efficiency with regard to lighting functions. The low energy lamps are such that they can oftentimes perform the job but are expensive. Furthermore, the expensive oftentimes is increased by additional expenses in having to reinstall low energy lamps that are substantially more expensive than regular lamps.

All of the foregoing methods of trying to conserve lighting energy have been deemed somewhat effective, but very expensive. Accordingly, this invention serves to overcome the deficiencies of the prior art and is very cost effective.

Recently, an attempt has been made to change the voltage levels with regard to incandescent discharge lamps and fluorescent lamps that have been previously installed. The effort has generally involved the changing of power delivered to the lamps by means of a switching network. Also, there has been an effort to use relay contacts, discrete transformer taps, and preselected timing.

The switching network is such that it switches between certain transformer taps to provide various levels of voltage to a bank of lights. The switching function can be provided by a number of discrete switches, depending upon the amount of change or different levels of voltage that are required by the lamps, as well as the number of lamps, or lamp circuits, to be controlled.

This has been exemplified by U.S. Pat. No. 4,189,664 issued to Richard L. Hirschfeld. The drawback of this kind of a system is that it radically changes the level of voltage from a higher level to a lower level, at which the lamps will operate. However, in making the change, it oftentimes extinguishes the fluorescent lamps and is not functional with respect to high intensity discharge lamps (HID lamps).

The foregoing extinguishing of lights is particularly prevalent with regard to high intensity discharge (HID) lamps, such as high pressure sodium, low pressure sodium, metal halide, and mercury vapor lamps. These types of lamps, when radically changed in voltage level, are extinguished. As a consequence, such a system has not worked at all on HID lamps.

To the contrary, this particular invention and controller works well to reduce high intensity discharge lamps from a higher level to a lower level of voltage for attendant energy savings. The invention is uniquely capable of metering the rate of change to accommodate arc tube temperature/pressure changes.

In addition to the foregoing features, the invention is such that it does not alter the wave form of the applied voltage. It effectively provides a means for starting the gaseous discharge lamps at a full rated voltage, or for that matter, other electrical equipment. This permits the lamps or electrical equipment to be stabilized and reach a normal operational equilibrium.

After normal operating equilibrium has been reached, the invention, as distinguished from the prior art, smoothly reduces the voltage at a prescribed rate of change compatible with change in arc tube temperatures and pressures internal to the lamp and maintains the voltage at a substantially constant level, even when the input voltage level changes.

Also, as distinguished from the prior art, the invention provides a means for reducing the output voltage over a predetermined time span from a full rated voltage to a selected lower voltage which is still sufficient to operate the lamps and provide an energy saving, while at the same time providing sufficient lighting energy for one to function in a normal capacity.

The invention can be installed in a distribution feeder line between the electrical source and a distribution panel, which further distinguishes if from the prior art, thereby avoiding the cost of retrofit as to new fixtures, solid state ballasts, computer managed local shedding, or low energy lamps, or, the cost for a multiplicity of switching relays required to switch a multiplicity of lamps or lamp circuits to various taps on a fixed ratio or fixed ratio autotransformer.

The invention allows for additional banks of lights or other devices to be put on the line by automatically resetting the voltage level to a full rated voltage. It also provides for the ability to interface with other sensors and control devices.

Finally, the invention overcomes the deficiencies of the prior art by allowing a set point output voltage level to be located at any particular value with respect to related voltage while at the same time sensing and compensating for additional electrical loads when added to the line controlled by this device. Further, the device adjusts for variances of the input voltage such that a pre-established set point output voltage level is maintained.

As a consequence, this invention is a substantial step over the prior art and should be read broadly in light of the following specification and claims attendant therewith.

SUMMARY OF THE INVENTION

In summation, this invention comprises a new and novel means for changing the voltage of a given load such as a bank of lights from a high set point to a lower set point in a smooth and linear manner to achieve reduction in energy consumption at a prescribed rate required by the type of load.

More particularly, the invention incorporates a means for efficiently controlling an electrical input to a load of lights or other power consuming devices. The input is interfaced with a variable transformer which in turn is connected to an output for providing power to the lights. The variable transformer is controlled by an amplifier comparator circuit through a voltage feedback system.

A bidirectional ramp generator allows for increases and decreases in voltage and is connected to the amplifier. The bidirectional ramp generator causes a rapid increase of voltage when required, such as at startup or when increased loads are sensed. A slow and steady linear decrease of voltage thereto places the lamps in a favorable voltage operating condition for saving energy while at the same time maintaining sufficient light.

A high voltage selection timer is incorporated in the controller to effectively provide for initiating the startup of the lights. In particular, the high voltage selection timer holds the high voltage for a prescribed period of time, after which the variable transformer is instructed to decrease the power on a slow and linear basis, so that extinguishing of the lights will not occur.

A wattmeter is connected to the controller so that upon detection of increased loads thereby, a feedback to the controller can be effectuated so that power changes can be provided for. In this manner, the system resets itself upon a load change detection. Upon reset, the system goes to a high voltage point and then holds the level for a prescribed period of time until the lights are again fully lit, to avoid extinguishing HID lights, at which time the voltage is decreased on a slow and smooth basis.

The foregoing invention allows one to decrease energy consumption, while at the same time effectuating sufficient light for a particular area that is to be lit. It is particularly adaptable, inasmuch as it avoids extinguishing the HID lamps upon decreases of voltage due to its smooth and linear decrease, rather than the abrupt changes associated with the prior art.

BRIEF DESCRIPTION OF THE DRAWINGS

The invention will be more clearly understood by reference to the description below taken in conjunction with the accompanying drawings wherein.

DESCRIPTION OF THE PREFERRED EMBODIMENTS

Figure 1:
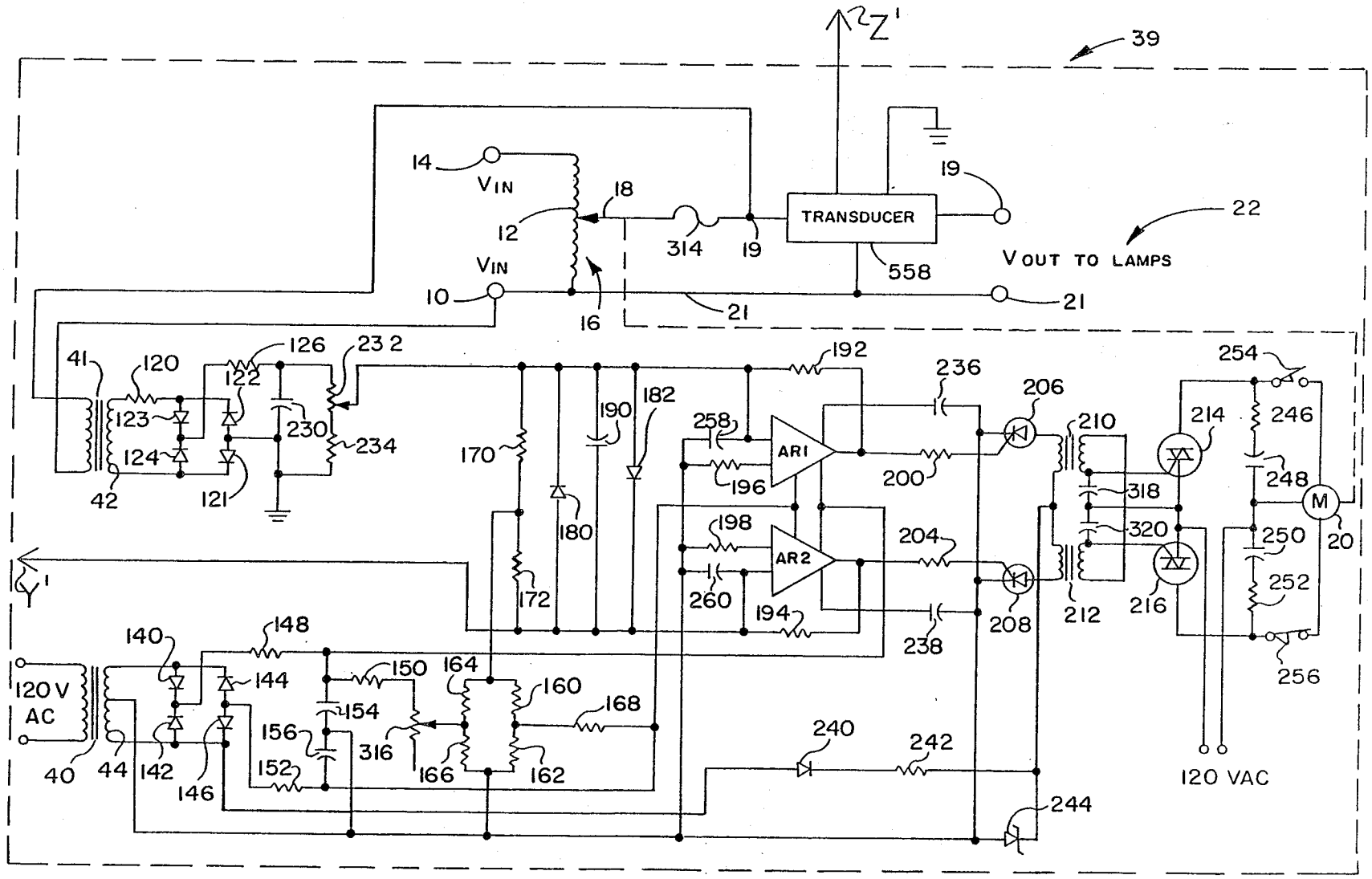
FIG. 1 shows a detailed showing of a portion of the circuit of this invention.
Figure 4:
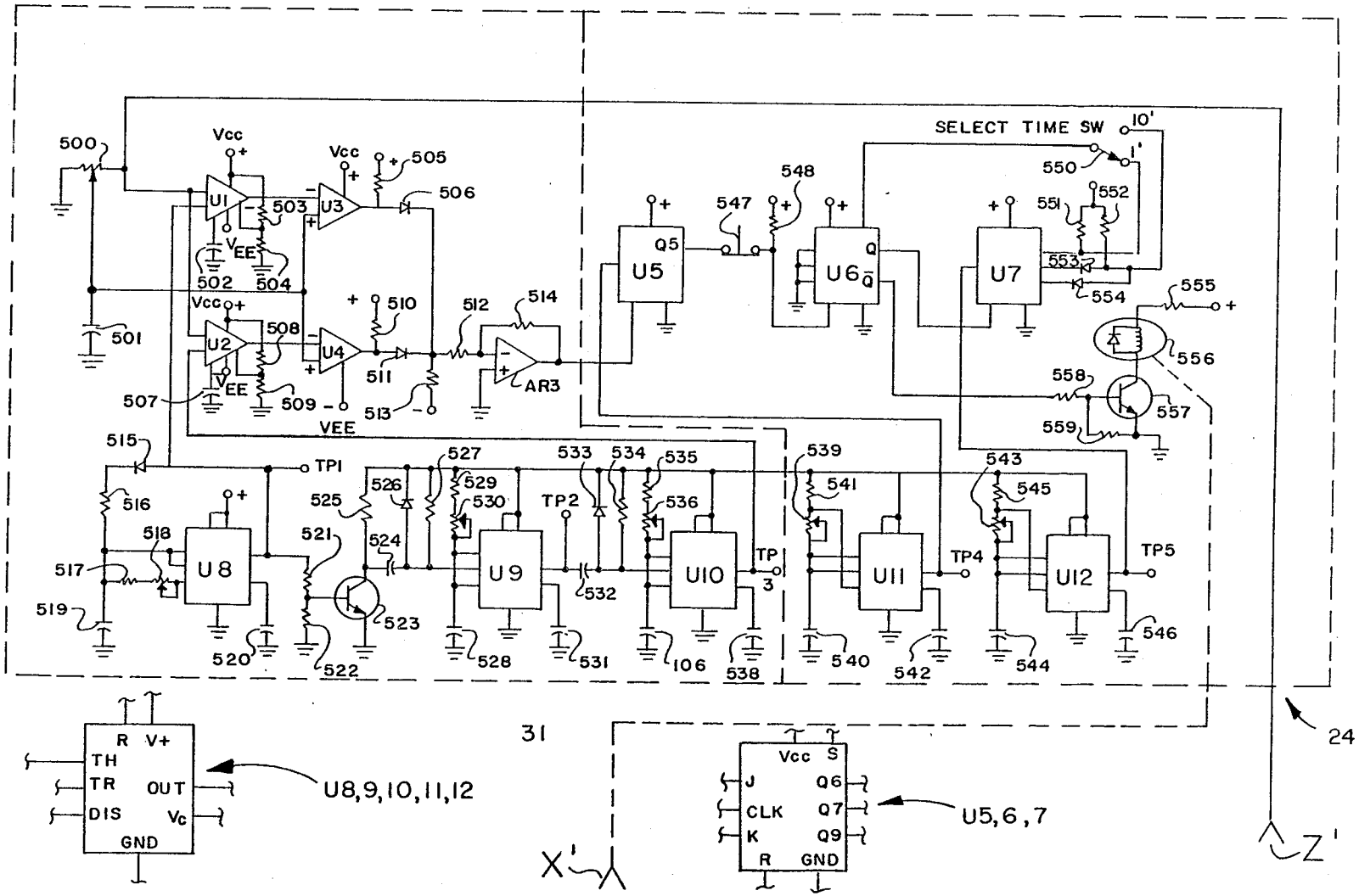
FIG. 4 shows a detailed showing of a portion of the circuit.
Figure 5:
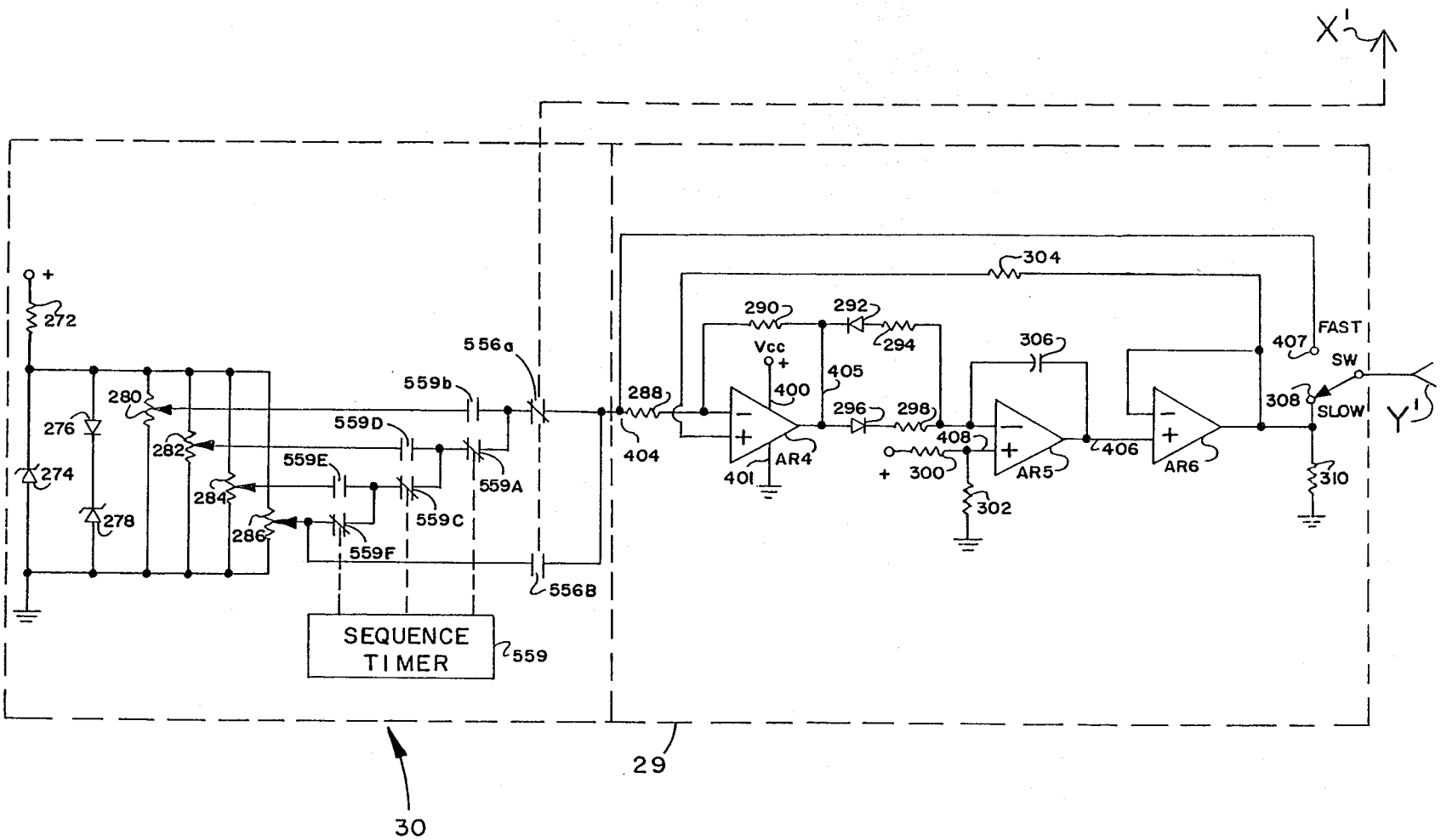
FIG. 5 shows another portion of the circuit as detailed.

Looking at FIGS. 1, 4 and 5 as interconnected by X' Y' and Z' and the other figures ancillary thereto, it can be seen that a number of components have been shown that have been blocked out as general operating features and major portions of this invention. A brief description in order to provide a generalized understanding of the invention shall be given initially with regard to the main components or functional block elements thereof.

As can be understood, lamps or other electrical energy consuming devices are connected to an electrical line. In particular, power lines comprising lines 10, 12 or 14 are shown. Lines 10 to 12 are across the line voltage of the alternating current input that is available to the entire system. Between lines 12 and 14 is the available boost voltage that can be provided by the controller.

The foregoing lines are controlled by means of a transformer 16 in the form of a variable transformer. The variable transformer 16 adjusts a wiper 18 upwardly and downwardly on the variable transformer in order to provide for an adjustment of voltages in accordance with this invention. The output from the variable transformer is across lines 19 and 21 that is shown in the form of an output for a lamp, namely output 22.

Figure 3:
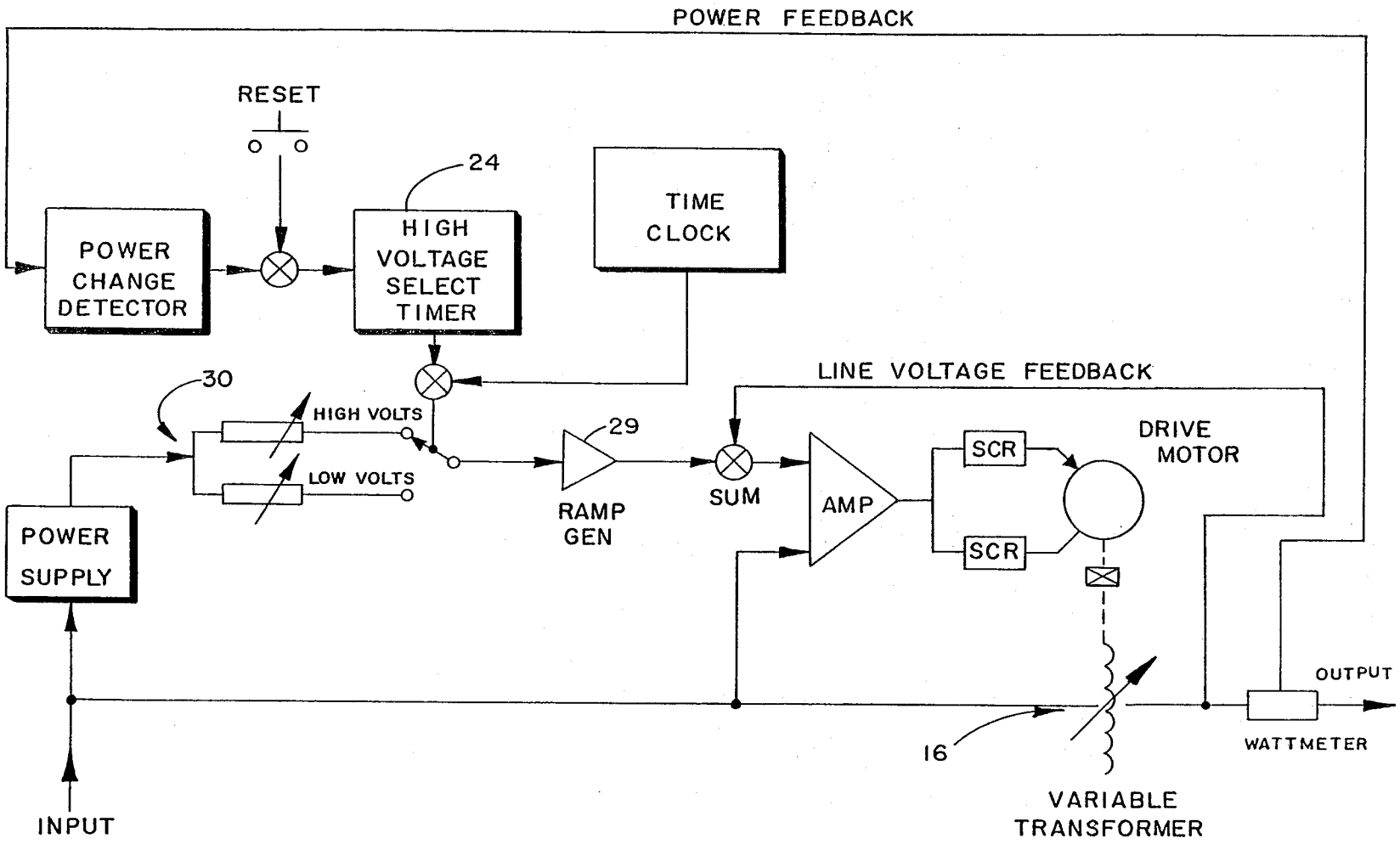
FIG. 3 shows a block diagram of the invention as to its main operative components.

In operation, a reset timer that provides a time delay and set point switching is shown blocked out as item 24 in FIG. 3. The reset timer 24 provides an adjustable preset time delay between changing from a high output voltage set point, to a low preset point. These two respective set points would be equivalent to the starting voltage required for certain lamps and the low voltage that would be effective in causing the lamps to function over an extended period of time without being extinguished. Generally, the low set point is established so that when transients and other variables are encountered on the line, the voltage will not drop below the point to cause extinguishing. Thus, the low set point voltage is anywhere from three to six percent above the amount of voltage required to maintain the lamps being lit. The length of the aforementioned time delay can be set by means of a time select switch 550 for a one minute or ten minute time delay. Other time set points are available if desired.

The foregoing time delay for lighting the lamps is determined by the required firing time of the specific type of lamps being used. As can be understood, fluorescent lamp, high intensity discharge lamps and other lamps within the general category of high intensity discharge lamps all require various starting times. For instance, this invention is utilized for controlling such high intensity discharge gaseous lamps as high pressure sodium, low pressure sodium, metal halide, mercury vapor, and fluorescent lamps, as well as other electrical equipment, without altering the wave form. In order to do this, there are various time delays and voltage set points that need to be accommodated with respect to each lamp for starting and continued lighting. When establishing these set points, the particular lamp is taken into consideration, so that both the time delay and set point aspects can be accounted for.

A preset voltage logic change is used to automatically change from the high set point to the low set point. These high intermediate and low set points are established with set point potentiometers 280, 282, 284 and 286. Set point 286 in the circuit is the higher set point. The reset timer establishes the change from the high set point and low set point of potentiometers 280 and 286 by way of the timing cycle. This then activates the drive system of the motorized variable transformer 16 which reduces the voltage supplied to the lamps to the low set point established within the potentiometer 280.

A unique aspect of this invention is the speed at which the lamps are dimmed from the high set point to the low set point which is controlled on a smooth or linear basis. This control function is established by a circuit generally shown as circuit 29. The circuit 29 is such that it causes a fast boost of the voltage when required but a very slow reduction of voltage. The slow reduction is such that it enables the invention to reduce voltage to high pressure sodium, metal halide and mercury vapor lamps without extinguishing the arc.

The potentiometers 280, 282, 284 and 286 provide the high intermediate and low voltage set points as desired within the range of the variable transformer 16. However, it must be controlled as to the system's function by a controller circuit. The controller 30 controls the system functions, such as initiating the timing cycle of the reset timer 24. In addition thereto, certain provisions can be made for externally programming the output voltage regulation to the lamps at each voltage set point. Furthermore, a dimming function can be inhibited either manually or on a programmed basis.

The variable transformer 16 provides an AC voltage to the output 22. The voltage and the KVA rating is determined by the load requirements of the system. Of course, greater banks of lights would require greater power requirements. Thus, more variable transformers would be ganged on a common motor drive shaft mechanism to provide the increased load handling capacity.

Boost capability is provided for greater voltage to the lamps during firing periods when incoming line voltages are lower than normal due to brownouts and other low voltage conditions.

There is no wave form change from the input to the output across the lighting load and virtually no electrical noise generated as in high frequency switching devices.

By way of example, to understand the system, the operating cycle is such that upon application of voltage to the lamps or the output 22, the reset timer 22 causes the preset switching logic to select the high set point of the potentiometer 286.

The foregoing selection causes the controller 39 to drive the motorized variable transformer 16 to a position where the output voltage is equal to the present value of the high set point of potentiometer 286.

The output voltage remains at this point and is regulated by the voltage regulator 39 until the reset timer 24 times out or establishes the end of its timing cycle. The foregoing then causes the preset switching logic to select the low set point 280 of the potentiometer. A selection of the low set point 280 in turn causes the controller 39 to drive the motorized variable transformer 16 to a position where the output voltage equals the preset value of the low set point of the potentiometer 280. As stated before, this low set point is equivalent to the amount of voltage required to maintain the bank of lights that are being driven connected across the output 22. The voltage level of course should allow for transients and other drops in voltage so that the lights will not be extinguished. Consequently, the low set point should be about three to four percent above the extinguishing voltage. This of course varies with each type of HID and fluorescent lamp.

The controller remains in this position with the output being regulated until the lamps are turned off, or until a variation or increased load on the line is sensed or other variables as will be described hereinafter.

Figure 2:
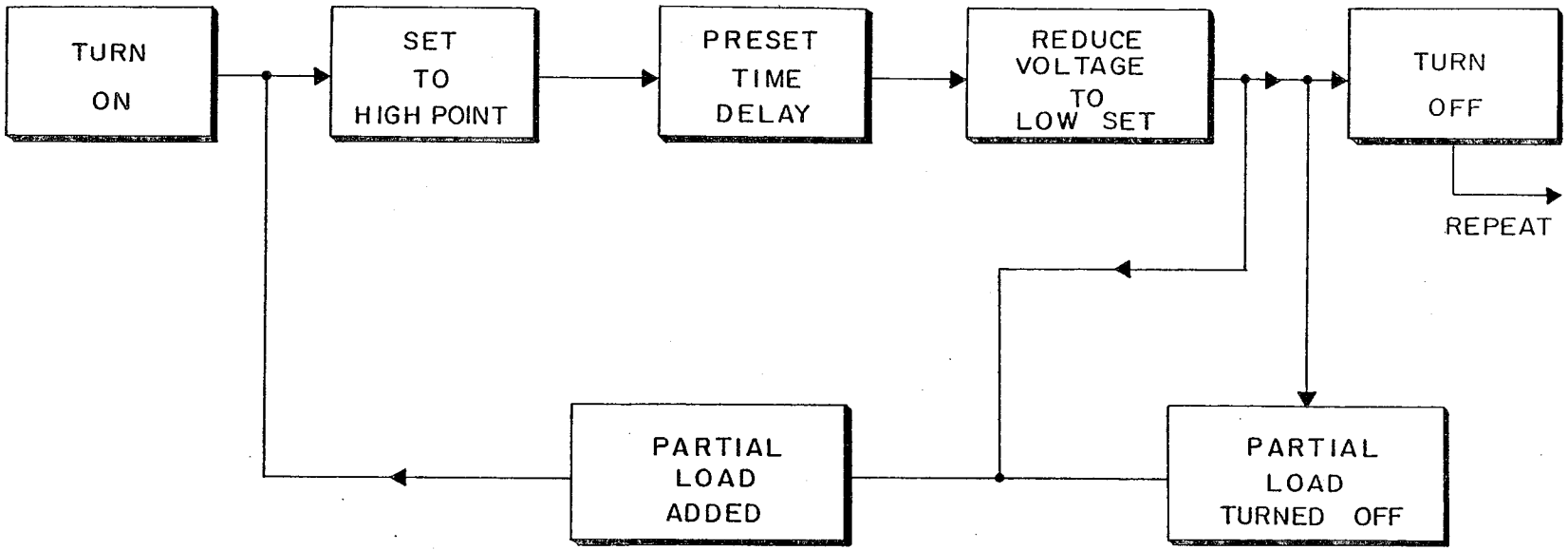
FIG. 2 shows a functional block diagram of the invention and the manner in which the invention would work.

The foregoing operative functions are generally shown in FIG. 2 when the lamps are to be turned on. When the lights are turned on as shown by the block, the high set point of potentiometer 30 is established and the preset time delay continues by virtue of the time delay set point switching of circuits 30 and 24. The timing thereafter creates a situation whereby after the appropriate lighting time has been maintained by the switching timer, the voltage is reduced to the low set point. This voltage reduction continues until a partial load is added, at which time the entire function is initiated again. When the partial load is turned off or the lamps are turned off in the entirety, the system awaits a repetition to initiate the operation.

Another way of explaining the elements of the system is through a block diagram shown as FIG.3. The electrical input across lines 10, 12 and 14 is shown as an input and labeled accordingly. The input then continues to the coils of the variable transformer 16. The input is also provided to a power supply that provides power for control of the system, as well as being connected to the high and low set points of the potentiometer control circuit 30. The high voltage timer 24 is shown connected to a time clock which in reality is an inherent portion of the timer. A power change detector 31 is shown connected to a watt-transducer in order to provide for load sensitivity and changes which then creates a reset of the controller and the timing function.

Circuit 29 which provides a bidirectional fast increase of voltage and a slow decrease of voltage is shown and is in turn connected to the amplifiers of the controller and output voltage from the transformer 16. A pair of TRIACS 214 and 216 are used to drive the motor on the transformer 16 with attendant line voltage feedback to provide for voltage control when loads are changed. However, the actual voltage control by the variable transformer 16 is accommodated by the amplifiers AR-1 and AR-2 lumped together as AMP of FIG. 3 reading the line voltage feedback and accordingly driving the transformer to the proper level of voltage input that has been preset by the potentiometer 30.

Looking more particularly at the specific components and operative features of the invention, it can be seen that the autotransformer 16 is driven by a motor 20. The motor is a pulsing motor with a solid state control circuit. The transformer is driven by the motor 20 so that its wiper 18 goes across a series of the transformer coils. A particular type of transformer that can be used is one having a variably sized series of coils so that the outer coils are larger than the inner coils of the autotransformer. This type of transformer has specifically been described in U.S. patent application Ser. No. 101,308, which is herein made a part and incorporated by reference herewith. In particular, that application describes a variable sized series of outside coils on which the wiper 18 operates and functions with and a smaller series of interior coils so that an autotransformer can be made with smaller and more effective coil configurations, thereby saving costs in material and labor. The transformer is sold by Staco Energy Products Company of Dayton, Ohio. It is generally described as a voltage control device for providing a regulated a.c. electrical output from an unregulated a.c. electrical input which includes a variable autotransformer having a pair of electrical windings. The autotransformer brush is moved along the first of the windings by means of a motor connected in a feedback control path with a voltage sensor circuit. The first winding is formed of a substantially larger diameter wire than the second winding and is wound in overlying relationship over the second winding on the core of the autotransformer.

A power supply control transformer 40 is shown, which provides the power to the controls. Voltage sensing transformer 41 senses the output voltage across lines 19 and 21.

The power detector circuit 31 basically remembers what the previous power consumption was and compares it to what it is. If it has increased, it starts a timer circuit 24 which raises the voltage for a fixed time. At the end of the time, the voltage drops to its preset low value.

The power is constantly monitored by the watt transducer 558. The transducer produces a voltage proportional to the power consumption across potentiometer 500. This voltage is also applied to the sample and hold modules U1 and U2.

Every six seconds, a pulse of 10 msec duration is generated by the astable multivibrator U8. This is referred to in part herein as clock A. The pulse is applied to U1, so that at the time of the pulse, the voltage level at the input is sampled and presented at the output and remains unchanged for the next six seconds.

The output of clock A is also inverted by transistor 523 differentiated by capacitor 524 and used to trigger the monostable multivibrator U9. The output of U9 changes state 3.4 second later. It is then differentiated by capacitor 532 and is used to trigger a monostable multivibrator U10. The output U10 is then a 10 msec pulse lagging clock A by 3.5 seconds. This shall be referred to in part herein as clock B.

A fraction of the present power voltage, determined by the setting of the wiper of potentiometer 500, is applied to comparators U3 and U4. The comparator U3 compares the fractional part of the present power to the power at the time of clock A. The comparator U4 does likewise but at the time of clock B. Should the power increase so that the selected fraction of it is greater than the power at the clock time, the comparator output goes from low to high. As soon as the present power is clocked into the comparator, its output goes low again. It is then comparing present power to a fraction of itself.

Because the power may change at any time with respect to clock A or may even occur during clock A, the second sample and hold (U2) and comparator U4 serve a redundant backup check to perform the same function as above but 3.5 seconds later. This insures that no matter when the power changes, the output of the OR circuit comprising diodes 506 and 511 is high for a minimum of 3.5 seconds. The high output of the OR circuit is applied to an inverter amplifier AR3, which forces its output low. An astable multivibrator U11 is provided which oscillates at a frequency of 600 pulses per minute. It is applied to the clock of a 12 bit binary counter, namely U5.

When the reset input goes low, the counter U5 starts counting and when it has counted 16 pulses, i.e., 1.6 seconds, the output Q5 goes from low to high. The counter or timer U5 is placed in the circuit to assure that the power level must change and stay changed for a minimum of 1.5 seconds. Shorter power level changes which would probably be the result of transients, noise, etc., accordingly do not affect the function.

When the reset input of a J-K flip-flop of U6 goes high, the output $\overline{Q}$ also goes high and turns on a transistor 557 which in turn energizes relay 556. This function selects the high voltage set point potentiometer.

The Q output of U6 goes low at the same time the foregoing takes place and removes the reset from the 12 bit binary counter U7. Astable multivibrator U12 oscillates at a frequency of 0.9375 cycles per second which is applied to the clock input. When the output Q6 goes from low to high, which is equivalent to 64 pulses or 60 seconds thereafter, the J-K flip-flop is set. The $\overline{Q}$ output goes high which resets the 12 bit counter U7, and the Q outputs goes low which turns off transistor 557 and de-energizes relay 556. The low set point potentiometer is then selected. The 10-minute operation is similar, but 640 pulses are counted before flip-flop U6 is set.

As an aside, time select switch 550 can be set to select either the one minute time delay or the ten minute time delay mode. The foregoing short time delay pertains to fluorescent lights, while the longer delay is required for the HID lights. Reset can also be accomplished by depressing switch 547 which momentarily interrupts the circuit between Q5 and U6 and initiates the timing cycle.

Looking more particularly at the drive motor control and voltage regulator circuits 39, it can be seen that current limiting resistor 120 is shown. The current limiting resistor 120 is connected to a bridge rectifier comprising diodes 121, 122, 123 and 124. The diodes 121 through 124 provide rectification and the resistor 120 in conjunction therewith provides the voltage limiting function from the output voltage sending circuit. Thus, rectification and voltage limiting are provided by the foregoing.

In order to power the amplifiers of this device with respect to the power thereto, a DC power supply is incorporated which consists in part of diodes 140, 142, 144 and 146. The diodes 140 through 146 maintain the DC power in conjunction with the resistor 148, and resistor 150 and a third resistor 152. Incorporated within the amplifier power source are capacitors 154 and 156 which provide a blocking function so that the amplifier power supply at point 160 is effectively controlled and properly rectified by the diode bridge of diodes 140 through 146. Capacitor 154 is on the plus side and capacitor 156 is on the minus side for the respective power portions of the network.

The bridge network comprising resistors 160, 162, 164 and 166 as well as a sensitivity potentiometer 316 form part of the amplifier supply voltage for amplifiers AR1 and AR2.

Resistors 170 and 172 are part of a bank of resistors to provide a voltage reference and serve to bias amplifiers AR1 and AR2. The amplifiers AR1 and AR2 are the two respective amplifiers that cause the voltage regulator and drive motor control function to operate in the manner that it does. In effect, these amplifiers serve as comparator amplifiers as to the voltage established by the foregoing network. When this reference voltage is not maintained, the amplifiers either increase or decrease the voltage by causing the transformer motor 20 to turn the transformer wiper 18 to increase or decrease output voltage at output 22.

A pair of diodes 180 and 182 limit the maximum voltage to the amplifier AR1 and AR2. The differential voltage between amplifier AR1 and AR2 represents the respective increase or decrease in voltage through the drive motor control and voltage regulator, causing the drive motor 20 of the transformer 16 to increase or decrease voltage therefrom.

In point of fact, the wiper 18 wipes across the coils of the transformer 16 in a manner to increase or decrease on a rotational basis, rather than on an up and down wiper basis. The motor 20 drives to the left or the right and the respective amplifiers AR1 or AR2 respectively drive the motor in those directions to increase or decrease voltage to the lamps. Switches 254 and 256 are limit switches which serve to open the circuit to drive motor 20 when the rotation of wiper 18 has reached the mechanical limits of travel.

A capacitor 190 functions to prevent ripples and smooths out the input to the amplifiers and the main portion of the system. Resistors 192 and 194 are amplifier feedback resistors for amplifiers AR1 and AR2 respectively. Resistors 196 and 198 respectively bias the input to the amplifiers AR1 and AR2. The resistors 200 and 204 are output resistors that provide the load for the resistors to cause a gating of the SCR's, respectively 206 and 208, so that the coils 210 or 212 can respectively cause the motor to go high or low or from the right to the left to provide increased or decreased voltage to the lamp output 22. The foregoing are interfaced through triaes 214 and 216 so that the output controlling the motor 20 goes high or low in a switched manner, compatible with the circuit hereof.

When short transients appear or a load is sensed on the line so that an intial set point is again desired by the set point switching of the network 20, a fast increase of voltage is applied to the lamp bank by the motor 20 turning the autotransformer rapidly. However, when coming down to a particular voltage at which the lamps are to operate after they have been lit, a slow voltage decrease circuit is utilized in the form of the circuit shown as circuit 29. This circuit is a key to maintaining HID lamps and other gaseous discharge lamps in their lit condition. The foregoing circuit 29 is implaced across the output of the potentiometer set point circuit 30.

The fast Up voltage Slow voltage Down Controller Circuit 29 operates to increase and decrease the voltage so as not to extinguish the lights, such as HID lamps. The small step function at point 404 created by changing the potentiometer 30 input is converted to a large step function at 405 by ramp direction switch, i.e., comparator AR4. This is accomplished by comparing reference levels at 404 and 407. When signal level 407 is more negative than signal level 404, the output level 405 is low approaching level 401 which may be zero volts or a negative voltage level (−Vc). When the signal level at 407 is more positive than the signal level at 404, the output level at 405 is high and is approaching the level at 400 which is a positive voltage source (+Vc). In other words, comparator AR-4 is a non-inverting step function amplifier with polarity determined by the signals on lines 404 and 407. The output signal 405 can be either saturated around voltage levels 400 and 401 or oscillating about a signal level when signal 404 is caused to vary through the motor variable feedback control loop.

The step function or oscillating output signal 405 is converted to a ramp function 406 by the ramp generator integrator AR5 and its associated components 292, 294, 296, 298, 300, 302 and 306. The reference level for the integrator is established by components 300 and 302. The output level 406 ramps up or down depending upon the polarity of signal 405 with respect to signal 408. When signal 405 is more positive than level 408, signal 406 is caused to decrease by charging capacitor 306 through resistor 294 and diode 292. When signal 405 is more negative than level 408, signal 406 is caused to decrease by charging capacitor 306 through resistor 294 and diode 292. When signal 405 is more negative than level 408, signal 406 is caused to decrease by discharging capacitor 306 through resistor 298 and diode 296. The output signal level 406 than varies, i.e., ramps, up or down, depending upon the time constant of components 294, 298, and 306 with an amplitude and direction determined by signal 405.

The ramp signal 406 is conditioned by the amplifier AR6 which is an amplifier/follower to match the impedance and supply the necessary current to drive the differential amplifier or system error detector circuit. The impedance matching follower circuit can be either inverting or non-inverting with the required gain or loss, i.e., amplification or attenuation necessary to match the ramp circuit signal 406 to the system input 407.

The time constants for the ramp circuit, i.e., components 294, 298, and 306 can be selected for any ramp up or ramp down time constant which is desired and can be the same ramp conditions in both directions for the output controller each time the switch 316 position is changed to a new position. The ability of circuit 29 to provide a slow down time is crucial to the control of certain types of HID lamps, and is deemed to be a unique portion hereof. Without such means, a rapid decrease in voltage will often extinguish such HID lamps.

The potentiometer circuit 30 consists of a voltage divider network consisting of a voltage limiting resistor 272, zener diodes 274, 278 and diode 276 to assure a stable reference voltage. Potentiometers 280, 282, 284 and 286 are used to establish high and low points, as well as intermediate set points. In particular, potentiometer 286 is the high set point and 280 is the low set point. Potentiometer 282 and 284 are the respective low and high intermediate set points.

Sequence timer 559 is used to select the desired reference voltage from one of the potentiometers according to a desired schedule with reference to real time. The desired reference voltage as to the high low and intermediate high and low set points is to maintain an intermediate amount of light, such as in a supermarket during shopping hours. During stocking after hours, the intermediate low set point at 282 can be changed to the lowest set point 280 which provides a minimum amount of light. Selection is accomplished by actuation of relay contact pairs 559*a* and 559*b*, 559*c* and 559*d*, or 559*e* and 559*f*. Selection of one of these relay pair switching contacts, or the switching of contacts 556*a* and 556*b* from reset relay 556 applies the desired reference voltage to the aforementioned fast up and slow down controller circuit 29.

The foregoing disclosure generally sets forth the aspects of this invention as it pertains to its various features, as well as the specific components thereof. These features and components, as well as the general overall operative features should be read broadly in light of the following claims hereinafter.

We claim:

1. A controller for electrically controlling the amount of voltage to an electrical lighting load comprising:

a variable transformer having means for connecting said transformer winding to an electrical power source;

means for connecting the output of said transformer to said lighting load;

motor means for changing the number of turns of said transformer winding for changing the voltage of the output of said transformer to said lighting load; and, means for controlling said motor means in the form of an electronic circuit comprising means for maintaining said winding at a high voltage output level for a predetermined period of time with circuit means for allowing said high output voltage to decrease to a lower output voltage of said transformer after said prescribed period of time wherein said circuit means comprises at least in part a control means in the form of a bi-directional ramping circuit that increases the voltage when an extra load is sensed in a more rapid manner than the decrease in voltage from the high voltage.

2. The controller as claimed in claim 1 wherein said winding changing means comprises:

a wiper that can be varied so as to provide lesser or greater amounts of winding for changing the output of said transformer.

3. The controller as claimed in claim 2 wherein:

said motor means is connected to said wiper for changing the amount of said winding for varying the voltage output.

4. The controller as claimed in claim 3 further comprising:

a voltage set point means for providing a predetermined high voltage and a predetermined low voltage.

5. The controller as claimed in claim 4 wherein:

said high and low set point means is a potentiometer.

6. The controller as claimed in claim 5 further comprising:

means for determining increases in load at the output of said transformer and feeding back such increases in load to said controller; and, electrical control means for increasing the voltage to a high set point, after said increases in load have been determined.

7. The controller as claimed in claim 6 wherein:

said means for detecting increases in load comprises a wattmeter.

8. The controller as claimed in claim 1 wherein:

said circuit means comprises at least in part a ramp generator integrator; and, said increase and decrease in controlling means provide for a sufficiently slow enough decrease in voltage so that when lights of a high intensity discharge (HID) type are lowered in voltage it will prevent extinguishing of said lights by avoiding rapid fluctuations in decreased voltage.

9. A means for controlling the voltage to a bank of lights such as high intensity discharge (HID) lamps and fluorescent lamps comprising:

a transformer having a winding to provide a voltage at the output that can be varied by means of changing the number of turns that are electrically responsive to each other by means of a wiper;

motor means for driving said wiper in response to an electrical controller;

means for connecting said transformer to a power line;

means for connecting said transformer to said bank of lights that is to be controlled by said transformer;

means for providing a set point at a pre-established high voltage and a set point at a pre-established low voltage, within said control circuit for driving said transformer wiper, so that said transformer wiper can move from the high set point voltage to the low set point voltage as pre-established by said voltage set point;

means within said controller for electrically holding said high set point voltage for a prescribed period of time prior to said transformer changing to the low set point voltage as established by said voltage set point circit; and, a bi-directional ramp generator means connected to timing means for changing the rate at which the voltage goes from a low to a high point and from a high point to a low point from said transformer, so that said decrease from said high set point voltage is appreciably slower than the voltage increase from said low set point to said high set point.

10. The controller as claimed in claim 9 further comprising:

an integrated circuit for providing the timing means having an RC network connected therewith for providing said timing means predicated upon the RC value.

11. The controller as claimed in claim 10 wherein:

said time delay from said high voltage to said low voltage of said controller has a switch means connected to the time delay output; and, means for connecting said switch means to the voltage set point control circuit for changing said voltage from a high set point to a low set point.

12. The controller with the set point circuit as claimed in claim 11 further comprising:

potentiometers for changing the respective high and low voltages and such intermediate voltages as are desired.

13. The circuit as claimed in claim 12 wherein:

said voltage set point has a relay means connected thereto for changing from said high set point to said low set point and from said low to said high set point; and, wherein, said switch from said time delay means connects to said relay for changing said relay from the high set point to the low set point.

14. The circuit as claimed in claim 13 further comprising:

means for lowering the voltage from said high set point to the low set point at a pre-established rate.

15. The controller as claimed in claim 14 wherein:
the rate of decrease of said voltage from said high set point to said low set point is established to prevent extinguishing high intensity discharge (HID) lamps connected to said transformer.

16. The controller as claimed in claim 15 wherein:
said lighting controller has an amplifier within said control circuit for purposes of differentiating feedback voltage with respect to a preset voltage that has been established; and,
connection means to said transformer from said amplifier to cause said transformer motor to change the wiper to increase or decrease the particular setting of said wiper for providing a particular voltage output which has been pre-established.

17. The circuit as claimed in claim 16 further comprising:
a voltage reference means within said controller connected to said differential amplifier to provide for a pre-established voltage which is to be maintained and regulated; and,
means for changing said transformer motor control means when changes with regard to the reference voltage are encountered with respect to the feedback voltage.

18. The controller as claimed in claim 17 further comprising:
switch means connected to said amplifier for changing the level of said voltage at the output from said transformer.

19. The controller as claimed in claim 1 further comprising:
a load sensing means to detect changes in loads, such as when an increased bank of lights are put on line and to accommodate the increased bank of lights by changing to a high set point from the low set point.

20. The controller as claimed in claim 19 wherein:
said load sensing means comprises a watt meter.

21. A system in combination with high intensity discharge lamps for purposes of lighting said lamps in an energy efficient manner comprising:
a transformer with a winding adapted for connection to a source of line voltage for driving said lamps;
an output from said transformer connected to said lamps;
a wiper for orienting the turns of said transformer for greater or lesser voltage output from said transformer;
motor means for driving said wiper in response to the voltage requirements established by said high intensity discharge lamps;
a controller for driving said motor for increasing or decreasing the attendant voltage from said transformer;
means for establishing a high and low voltage set point of said high intensity discharge lamps wherein said high voltage is the requisite voltage for starting said lamps and said low voltage is the voltage necessary to continue lighting said lamps without extinguishing them;
time delay means connected to said controller for causing said controller to establish a high voltage for a prescribed period of time for lighting the lamps after which the low voltage can be applied to said lamps;
circuit ramp means to decrease the voltage from the high voltage point to the low voltage point at a slower rate than increases of voltage to the higher voltage level and at a level sufficient to avoid extinguishing said high intensity discharge lamp during said voltage decreases.

22. The combination as claimed in claim 21 wherein:
said high intensity discharge lamps are high pressure sodium lamps.

23. The combination as claimed in claim 21 wherein:
said high intensity discharge lamps are low pressure sodium lamps.

24. The combination as claimed in claim 21 wherein:
said high intensity discharge lamps are metal halide lamps.

25. The combination as claimed in claim 21 wherein:
said high intensity discharge lamps are mercury vapor lamps.

26. The combination as claimed in claim 21 further comprising:
a circuit means for rapidly increasing the voltage upon startup or upon going from the lower set point voltage to the higher set point voltage of the controller; and,
means to decrease the voltage attendant therewith from the high voltage point to the low voltage point at a slower rate and at a level sufficient to avoid extinguishing said high intensity discharge lamp.

27. The combination as claimed in claim 21 further comprising:
a differential amplifier within said controller for detecting changes in set point voltage established by said set point voltage circuit to accommodate it.

28. The combination as claimed in claim 21 wherein:
said means for establishing when increased loads have been added on the line includes a double clock function for triggering said change wherein one clock lags the other to assure that load changes of a particular duration have occurred to avoid actuation by transients.

29. The combination as claimed in claim 21 wherein:
said high and low set points are established in pairs to provide extreme high and low set points and at least one intermediate high and low set point.

* * * * *